US011232925B2

(12) United States Patent
Chang et al.

(10) Patent No.: US 11,232,925 B2
(45) Date of Patent: Jan. 25, 2022

(54) SYSTEM AND METHOD FOR IMPROVED BEAM CURRENT FROM AN ION SOURCE

(71) Applicant: Applied Materials, Inc., Santa Clara, CA (US)

(72) Inventors: Shengwu Chang, Hamilton, MA (US); Frank Sinclair, Boston, MA (US); Michael St. Peter, Gloucester, MA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 16/735,053

(22) Filed: Jan. 6, 2020

(65) Prior Publication Data

US 2021/0066017 A1 Mar. 4, 2021

Related U.S. Application Data

(60) Provisional application No. 62/895,251, filed on Sep. 3, 2019.

(51) Int. Cl.

| | |
|---|---|
| ***H01J 7/24*** | (2006.01) |
| ***H05B 31/26*** | (2006.01) |
| ***H01J 27/20*** | (2006.01) |

(52) U.S. Cl.

CPC ..... *H01J 27/205* (2013.01)

(58) Field of Classification Search

CPC combination set(s) only.

See application file for complete search history.

(56) References Cited

U.S. PATENT DOCUMENTS

| | | | |
|---|---|---|---|
| 5,089,746 | A | 2/1992 | Rosenblum et al. |
| 5,852,345 | A | 12/1998 | Armini |

(Continued)

FOREIGN PATENT DOCUMENTS

| | | | |
|---|---|---|---|
| CN | 1428001 | A | 7/2003 |
| CN | 101285167 | A | 10/2008 |

(Continued)

OTHER PUBLICATIONS

International Search Report and Written Opinion dated Nov. 20, 2020 in co-pending PCT application No. PCT/US2020/045749.

(Continued)

*Primary Examiner* — Minh D A

(74) *Attorney, Agent, or Firm* — Nields, Lemack & Frame, LLC

(57) ABSTRACT

An IHC ion source that employs a negatively biased cathode and one or more side electrodes is disclosed. The one or more side electrodes are left electrically unconnected in certain embodiments and are grounded in other embodiments. The floating side electrodes may be beneficial in the formation of certain species. In certain embodiments, a relay is used to allow the side electrodes to be easily switched between these two modes. By changing the configuration of the side electrodes, beam current can be optimized for different species. For example, certain species, such as arsenic, may be optimized when the side electrodes are at the same voltage as the chamber. Other species, such as boron, may be optimized when the side electrodes are left floating relative to the chamber. In certain embodiments, a controller is in communication with the relay so as to control which mode is used, based on the desired feed gas.

19 Claims, 5 Drawing Sheets

(56) References Cited

U.S. PATENT DOCUMENTS

| | | | | |
|---|---|---|---|---|
| 6,335,535 | B1 * | 1/2002 | Miyake | H01L 21/0445 250/492.21 |
| 6,777,686 | B2 | 8/2004 | Olson et al. | |
| 7,102,139 | B2 | 9/2006 | Low et al. | |
| 7,446,326 | B2 | 11/2008 | Chaney et al. | |
| 8,253,114 | B2 | 8/2012 | Yamashita et al. | |
| 8,263,944 | B2 | 9/2012 | Koo et al. | |
| 9,691,584 | B1 * | 6/2017 | Tieger | H01J 37/3266 |
| 9,818,570 | B2 | 11/2017 | Alvarado et al. | |
| 10,290,461 | B1 | 5/2019 | Tieger et al. | |
| 10,896,799 | B1 * | 1/2021 | Becker | H01J 27/02 |
| 2001/0042836 | A1 | 11/2001 | Olson et al. | |
| 2002/0162508 | A1 | 11/2002 | Dykstra | |
| 2003/0094902 | A1 | 5/2003 | Yamashita | |
| 2007/0152165 | A1 | 7/2007 | Kim et al. | |
| 2007/0194252 | A1 | 8/2007 | Horsky et al. | |
| 2008/0157681 | A1 * | 7/2008 | Huang | H01J 37/045 315/119 |
| 2008/0220596 | A1 | 9/2008 | Olander et al. | |
| 2009/0242793 | A1 | 10/2009 | Low et al. | |
| 2010/0051825 | A1 * | 3/2010 | Yamashita | H01J 27/14 250/423 R |
| 2010/0148089 | A1 | 6/2010 | Horsky et al. | |
| 2010/0155619 | A1 | 6/2010 | Koo et al. | |
| 2011/0139613 | A1 | 6/2011 | Ikejiri et al. | |
| 2012/0286152 | A1 | 11/2012 | Jones et al. | |
| 2013/0140450 | A1 | 6/2013 | Graupera et al. | |
| 2014/0061501 | A1 | 3/2014 | Sinha et al. | |
| 2014/0127394 | A1 | 5/2014 | Gammel et al. | |
| 2014/0265854 | A1 | 9/2014 | Horsky et al. | |
| 2015/0053866 | A1 | 2/2015 | Aramaki et al. | |
| 2015/0248992 | A1 | 9/2015 | Sinha et al. | |
| 2016/0247669 | A1 | 8/2016 | Tateishi et al. | |
| 2017/0117113 | A1 | 4/2017 | Alvarado et al. | |
| 2017/0278690 | A1 | 9/2017 | Aliman et al. | |
| 2017/0292186 | A1 | 10/2017 | Reinicker et al. | |
| 2018/0247797 | A1 * | 8/2018 | Gorokhovsky | C23C 16/27 |
| 2018/0308658 | A1 | 10/2018 | Matsubara et al. | |
| 2018/0374689 | A1 * | 12/2018 | Abraham | H01J 37/3467 |
| 2019/0122851 | A1 | 4/2019 | Tieger et al. | |
| 2019/0139742 | A1 * | 5/2019 | McLaughlin | H01J 37/08 |
| 2019/0180971 | A1 * | 6/2019 | Becker | H01J 37/3438 |
| 2021/0066019 | A1 | 3/2021 | Chang et al. | |

FOREIGN PATENT DOCUMENTS

| | | | |
|---|---|---|---|
| CN | 101661862 | A | 3/2010 |
| CN | 101960554 | A | 1/2011 |
| CN | 102034665 | A | 4/2011 |
| CN | 104051209 | A | 9/2014 |
| CN | 105655217 | A | 6/2016 |
| JP | 2007-184218 | A | 7/2007 |
| JP | 2009-211955 | A | 9/2009 |
| JP | 2010-80429 | A | 4/2010 |
| JP | 2011-124059 | A | 6/2011 |
| JP | 2016-157523 | A | 9/2016 |
| KR | 10-2009-0055710 | A | 6/2009 |
| TW | 200300949 | A | 6/2003 |
| TW | I227906 | B | 2/2005 |
| TW | 200947496 | A | 11/2009 |
| TW | 201435956 | A | 9/2014 |

OTHER PUBLICATIONS

International Search Report and Written Opinion dated Nov. 24, 2020 in corresponding PCT application No. PCT/US2020/045748.

Office action dated Feb. 17, 2021 in co-pending U.S. Appl. No. 16/734,979.

Notice of allowance dated Jun. 10, 2021 in co-pending U.S. Appl. No. 16/734,979.

* cited by examiner

SYSTEM AND METHOD FOR IMPROVED BEAM CURRENT FROM AN ION SOURCE

FIELD

Embodiments of the present disclosure relate to an ion source, and more particularly, an indirectly heated cathode (IHC) ion source where the side electrodes may be floated or grounded to improve beam current.

BACKGROUND

Various types of ion sources may be used to create the ions that are used in semiconductor processing equipment. One type of ion source is the indirectly heated cathode (IHC) ion source. IHC ion sources operate by supplying a current to a filament disposed behind a cathode. The filament emits thermionic electrons, which are accelerated toward and heat the cathode, in turn causing the cathode to emit electrons into the chamber of the ion source. Since the filament is protected by the cathode, its life may be extended relative to a Bernas ion source. The cathode is disposed at one end of a chamber. A repeller is typically disposed on the end of the chamber opposite the cathode. The cathode and repeller may be biased so as to repel the electrons, directing them back toward the center of the chamber. In some embodiments, a magnetic field is used to further confine the electrons within the chamber.

In certain embodiments of these ion sources, side electrodes are also disposed on one or more walls of the chamber. These side electrodes may be biased so as to control the position of ions and electrons, so as to increase the ion density near the center of the chamber. An extraction aperture is disposed along another side, proximate the center of the chamber, through which the ions may be extracted.

The optimal voltage applied to the cathode, repeller and side electrodes differs, depending on the feed gas that is being used.

Therefore, a system and method that improves the beam current for various species would be beneficial. Further, it would be advantageous if this system were readily adaptable for different species.

SUMMARY

An IHC ion source that employs a negatively biased cathode and one or more side electrodes is disclosed. The one or more side electrodes are left electrically unconnected in certain embodiments and are grounded in other embodiments. The floating side electrodes may be beneficial in the formation of certain species. In certain embodiments, a relay is used to allow the side electrodes to be easily switched between these two modes. By changing the configuration of the side electrodes, beam current can be optimized for different species. For example, certain species, such as arsenic, may be optimized when the side electrodes are at the same voltage as the chamber. Other species, such as boron, may be optimized when the side electrodes are left floating relative to the chamber. In certain embodiments, a controller is in communication with the relay so as to control which mode is used, based on the desired feed gas.

According to one embodiment, an ion source is disclosed. The ion source comprises a chamber, comprising at least one electrically conductive wall; a cathode disposed on one end of the chamber; a first side electrode disposed on one side wall; and an arc power supply to bias the cathode at a negative voltage relative to the electrically conductive wall; wherein the first side electrode is electrically floating. In certain embodiments, the ion source further comprises a second side electrode disposed on a second side wall, wherein the second side electrode is electrically floating. In some embodiments, the ion source comprises a repeller disposed on an opposite end of the chamber.

According to another embodiment, an ion source is disclosed. The ion source comprises a chamber, comprising at least one electrically conductive wall; a cathode disposed on one end of the chamber; a first side electrode disposed on one side wall; and a switch having two terminals, wherein a first terminal is in communication with the electrically conductive wall and a second terminal is in communication with the first side electrode. In certain embodiments, the switch comprises a select signal to select between a first position where the switch is open and a second position where the switch is closed. In certain embodiments, a controller is in communication with the select signal. In some embodiments, the controller selects between the first position and the second position, based on a feed gas that is used. In certain embodiments, the controller sets the switch to the second position if an arsenic-based feed gas is used. In certain embodiments, the controller sets the switch to the first position if a boron-based feed gas is used. In some embodiments, the switch comprises a relay. In certain embodiments, the switch comprises a single pole, single throw switch. In some embodiments, the ion source further comprises a second side electrode disposed on a second side wall, wherein the second side electrode is in communication with the first side electrode and the second terminal. In some embodiments, the ion source further comprises an arc power supply to bias the cathode at a negative voltage relative to the electrically conductive wall. In some embodiments, the ion source comprises a repeller disposed on an opposite end of the chamber.

According to another embodiment, an ion source is disclosed. The ion source comprises a chamber, comprising at least one electrically conductive wall; a filament disposed on one end of the chamber; a first side electrode disposed on one side wall; a switch having two terminals, wherein a first terminal is in communication with the electrically conductive wall and a second terminal is in communication with the first side electrode, such that the switch has a first position wherein the first side electrode is electrically floating and a second position wherein the first side electrode is in communication with the electrically conductive wall; and a controller, in communication with the switch, wherein the controller receives an input and selects the first position or the second position, based on the input. In certain embodiments, the ion source comprises a cathode, wherein the filament is disposed behind the cathode. In certain embodiments, the ion source comprises an arc power supply to bias the cathode at a negative voltage relative to the electrically conductive wall. In some embodiments, the ion source comprises a second side electrode disposed on a second side wall wherein the second side electrode is in communication with the first side electrode and the second terminal. In some embodiments, the ion source comprises a repeller disposed on an opposite end of the chamber.

BRIEF DESCRIPTION OF THE FIGURES

For a better understanding of the present disclosure, reference is made to the accompanying drawings, which are incorporated herein by reference and in which.

DETAILED DESCRIPTION

Figure 1:
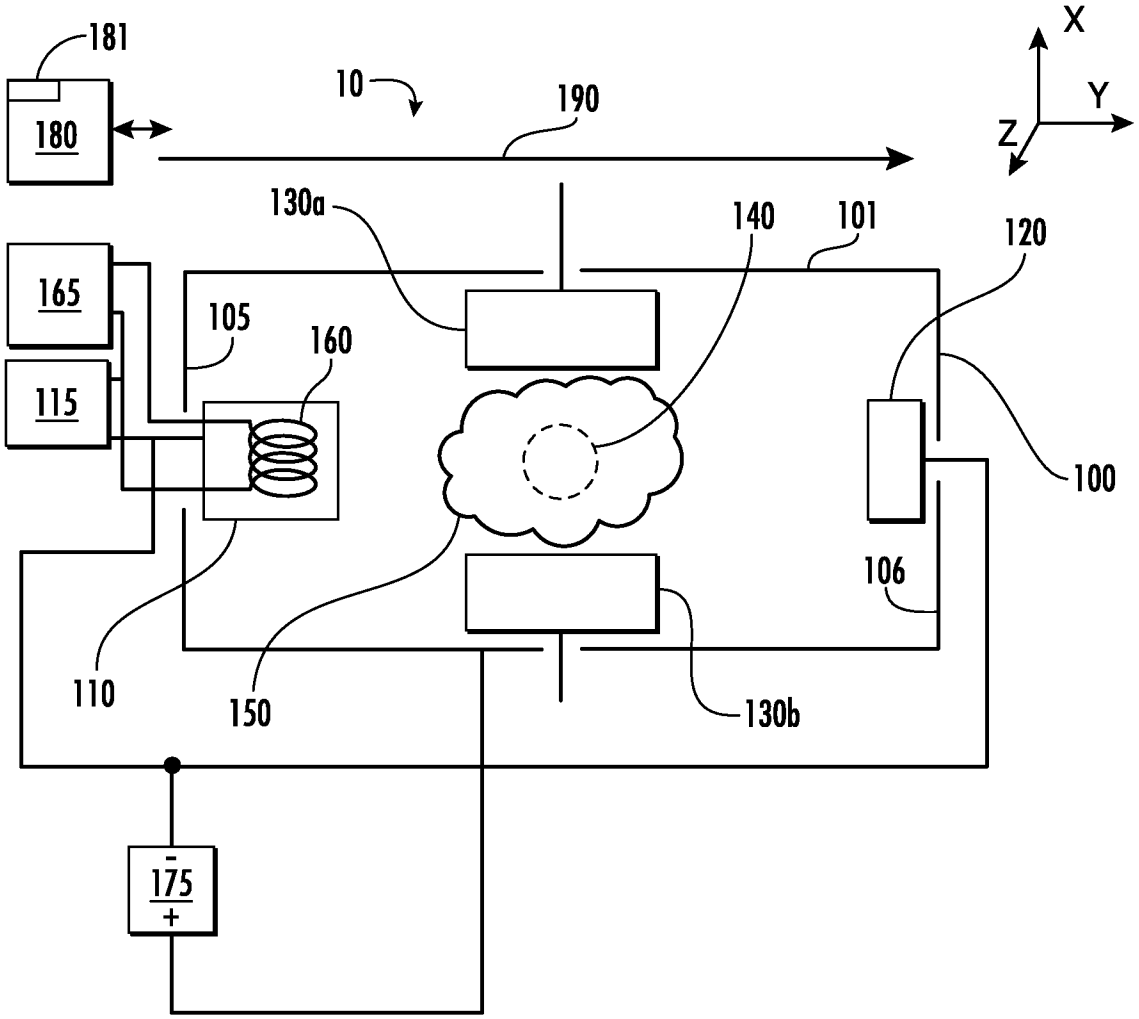
FIG. 1 is an ion source in accordance with one embodiment.
Figure 2:
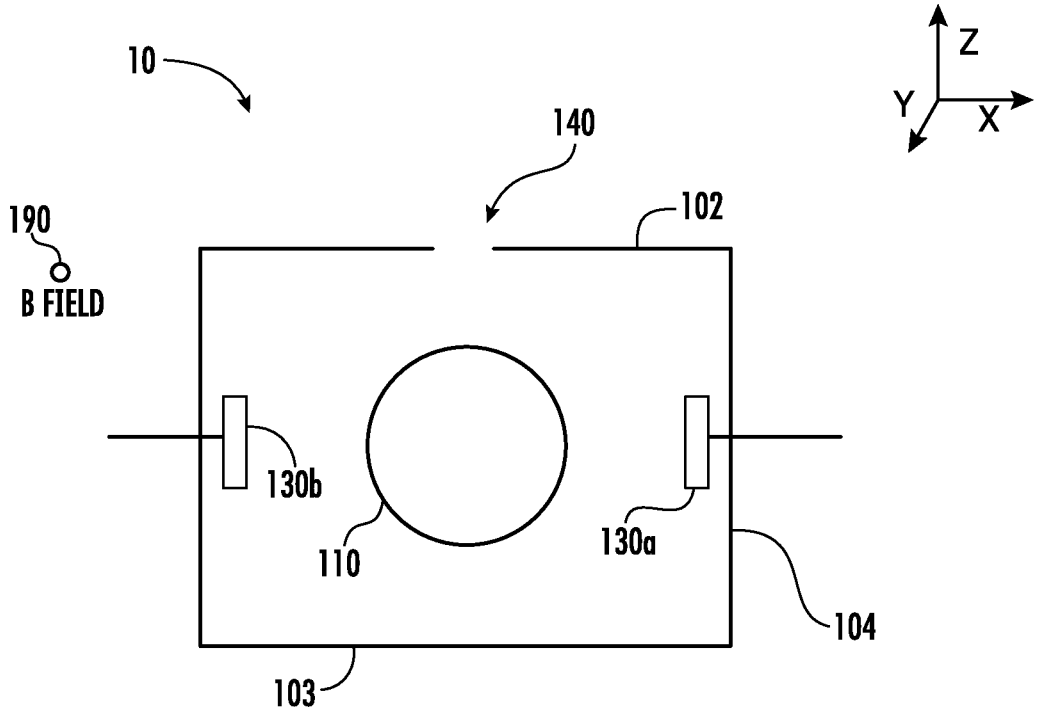
FIG. 2 is a cross-sectional view of the ion source of FIG. 1.

As described above, the optimal voltages that are to be applied to the various components within an ion source may vary depending on the feed gas that is used. Unexpectedly, it has been found that by disconnecting the side electrodes from all power supplies may improve fractionalization for certain species. FIG. 1 shows an ion source 10 that allows the side electrodes to be floating in certain embodiments. FIG. 2 shows a cross-sectional view of the ion source 10 of FIG. 1.

The ion source 10 may be an indirectly heated cathode (IHC) ion source. The ion source 10 includes a chamber 100, comprising two opposite ends, and walls 101 connecting to these ends. These walls 101 include side walls 104, an extraction plate 102 and a bottom wall 103 opposite the extraction plate 102. The walls 101 of the chamber 100 may be constructed of an electrically conductive material and may be in electrical communication with one another. In certain embodiments, all of the walls 101 are electrically conductive. In other embodiments, at least one wall 101 is electrically conductive. A cathode 110 is disposed in the chamber 100 at a first end 105 of the chamber 100. A filament 160 is disposed behind the cathode 110. The filament 160 is in communication with a filament power supply 165. The filament power supply 165 is configured to pass a current through the filament 160, such that the filament 160 emits thermionic electrons. Cathode bias power supply 115 biases filament 160 negatively relative to the cathode 110, so these thermionic electrons are accelerated from the filament 160 toward the cathode 110 and heat the cathode 110 when they strike the back surface of cathode 110. The cathode bias power supply 115 may bias the filament 160 so that it has a voltage that is between, for example, 200V to 1500V more negative than the voltage of the cathode 110. The cathode 110 then emits thermionic electrons on its front surface into chamber 100.

Thus, the filament power supply 165 supplies a current to the filament 160. The cathode bias power supply 115 biases the filament 160 so that it is more negative than the cathode 110, so that electrons are attracted toward the cathode 110 from the filament 160. Additionally, the cathode 110 is electrically connected to the arc power supply 175. The positive terminal of the arc power supply 175 may be electrically connected to the walls 101, such that the output from the arc power supply 175 is negative with respect to the walls 101. In this wall, the cathode 110 is maintained at a negative voltage relative to the chamber 100. In certain embodiments, the cathode 110 may be biased at between −30V and −150V relative to the chamber 100.

In certain embodiments, the electrically conductive walls of the chamber 100 is connected to electrical ground. In certain embodiments, the walls 101 provide the ground reference for the other power supplies.

In this embodiment, a repeller 120 is disposed in the chamber 100 on the second end 106 of the chamber 100 opposite the cathode 110. As the name suggests, the repeller 120 serves to repel the electrons emitted from the cathode 110 back toward the center of the chamber 100. For example, in certain embodiments, the repeller 120 may be biased at a negative voltage relative to the chamber 100 to repel the electrons. For example, in certain embodiments, the repeller 120 is biased at between −30V and −150V relative to the chamber 100. In these embodiments, the repeller 120 may be in electrical communication with the arc power supply 175, as shown in FIG. 1. In other embodiments, the repeller 120 may be floated relative to the chamber 100. In other words, when floated, the repeller 120 is not electrically connected to a power supply or to the chamber 100. In this embodiment, the voltage of the repeller 120 tends to drift to a voltage close to that of the cathode 110. Alternatively, the repeller 120 may be electrically connected to the walls 101.

In certain embodiments, a magnetic field 190 is generated in the chamber 100. This magnetic field is intended to confine the electrons along one direction. The magnetic field 190 typically runs parallel to the side walls 104 from the first end 105 to the second end 106. For example, electrons may be confined in a column that is parallel to the direction from the cathode 110 to the repeller 120 (i.e. the y direction). Thus, electrons do not experience electromagnetic force to move in the y direction. However, movement of the electrons in other directions may experience an electromagnetic force.

In the embodiment shown in FIG. 1, first side electrode 130*a* and second side electrode 130*b* may be disposed on side walls 104 of the chamber 100, such that the side electrodes are within the chamber 100. The side electrodes 130*a*, 130*b* may be U-shaped or tubular shaped to surround the plasm. The side electrodes 130*a*, 130*b* may each be left electrically floating. In other words, the side electrodes 130*a*, 130*b* are not in communication with any power supply or ground.

In FIG. 2, the cathode 110 is shown against the first end 105 of the ion source 10. First side electrode 130*a* and second side electrode 130*b* are shown on opposite side walls 104 of the chamber 100. The magnetic field 190 is shown directed out of the page, in the Y direction. In certain embodiments, the side electrodes 130*a*, 130*b* may be separated from the side walls 104 of the chamber 100 through the use of insulators or vacuum gaps.

Each of the cathode 110, the repeller 120, the first side electrode 130*a* and the second side electrode 130*b* is made of an electrically conductive material, such as a metal. Each of these components may be physically separated from the walls 101, so that a voltage, different from ground, may be applied to each component.

Disposed on the extraction plate 102, may be an extraction aperture 140. In FIG. 1, the extraction aperture 140 is disposed on a side that is parallel to the X-Y plane (parallel to the page). Further, while not shown, the ion source 10 also comprises a gas inlet through which the feed gas to be ionized is introduced to the chamber 100. The feed gas may be any desired species, including, but not limited to, a boron-based feed gas, such as boron trifluoride ($BF_3$) or $B_2F_4$ or an arsenic-based feed gas, such as arsine ($AsH_3$).

A controller 180 may be in communication with one or more of the power supplies such that the voltage or current supplied by these power supplies may be modified by the controller 180. The controller 180 may include a processing unit, such as a microcontroller, a personal computer, a special purpose controller, or another suitable processing unit. The controller 180 may also include a non-transitory storage element, such as a semiconductor memory, a magnetic memory, or another suitable memory. This non-transitory storage element may contain instructions and other data that allows the controller 180 to perform the functions described herein.

The controller 180 may be used to supply control signals to one or more of the power supplies, such as arc power supply 175, cathode bias power supply 115 and filament power supply 165 so as to vary their respective outputs. In certain embodiments, the controller 180 may have an input device 181, such as a keyboard, touch screen or other device. An operator may utilize this input device 181 to inform the controller 180 of the desired output voltage for each power supply. In other embodiments, the operator may select a desired feed gas and the appropriate output voltage of each power supply for this feed gas may be automatically configured by the controller 180.

During operation, the filament power supply 165 passes a current through the filament 160, which causes the filament 160 to emit thermionic electrons. These electrons strike the back surface of the cathode 110, which may be more positive than the filament 160, causing the cathode 110 to heat, which in turn causes the cathode 110 to emit electrons into the chamber 100. These electrons collide with the molecules of gas that are fed into the chamber 100 through the gas inlet. These collisions create positive ions, which form a plasma 150. The plasma 150 may be confined and manipulated by the electrical fields created by the cathode 110, the repeller 120, the first side electrode 130*a* and the second side electrode 130*b*. Further, in certain embodiments, the electrons and positive ions may be somewhat confined by the magnetic field 190. In certain embodiments, the plasma 150 is confined near the center of the chamber 100, proximate the extraction aperture 140.

Unexpectedly, it has been found that by disconnecting the side electrodes 130*a*, 130*b* from all other voltage sources and ground may increase fractionalization of certain feed gasses. Specifically, without being bound to any particular theory, it is believed that electrons strike the side electrodes 130*a*, 130*b* causing the side electrodes 130*a*, 130*b* to become negatively charged. At a certain negative voltage, the repelling force of the negatively charged electrodes reduces the number of additional electrons that strike the side electrodes 130*a*,130*b*. In other words, electrons continue to strike the side electrodes 130*a*, 130*b* until an equilibrium voltage is reached. The side electrodes 130*a*, 130*b* may then maintain this negative voltage. Once the side electrodes 130*a*, 130*b* become negatively charged, it is believed that the negatively biased side electrodes 130*a*, 130*b* repel the electrons in the plasma 150 away from the sides and toward the center of the chamber 100, where more collisions may occur with the feed gas. This enhanced confinement of the electrons may explain the increased fractionalization of certain species. In contrast, when the side electrodes 130*a*, 130*b* are grounded, the electrons may be lost to the electrodes or to the chamber 100 as the electrons from the plasma 150 are drawn to these surfaces.

In one test, it was found that the side electrodes 130*a*, 130*b* attain a voltage of about −9.5V relative to the chamber 100 when boron trifluoride is used in the chamber. In another test, it was found that the side electrodes 130*a*, 130*b* attain a voltage of about −3.8V relative to the chamber 100 when arsine is used in the chamber 100.

It was found that fractionalization of boron is enhanced by inducing a negative voltage on the side electrodes 130*a*, 130*b*, which are electrically floating. However, fractionalization of other species, such as arsenic, is not enhanced by the application of a negative voltage. Rather, for these species, it has been found that fractionalization is maximized when the side electrodes 130*a*, 130*b* are at the same voltage as the chamber 100.

Figure 3:
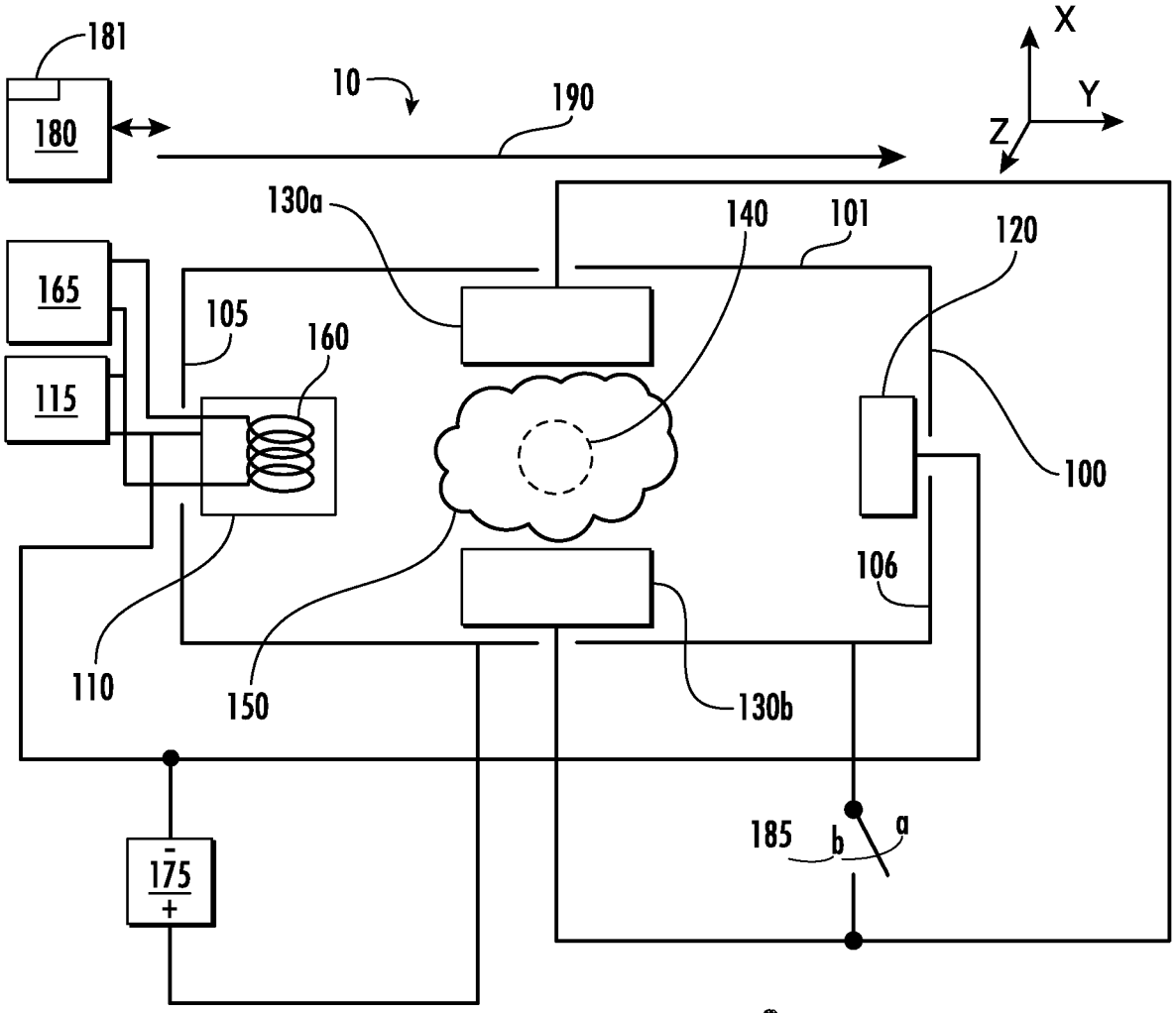
FIG. 3 is an ion source in accordance with a second embodiment.

Thus, in certain embodiments, such as is shown in FIG. 3, a switch 185 is employed. This switch 185 may be a single pole, single throw relay. Due to the high voltages, a relay utilizing a magnet coil may be used. The switch 185 has two terminals and a select signal. One terminal of the switch 185 is in electrical communication with the walls 101 of the chamber 100. The second terminal is in electrical communication with the first side electrode 130*a* and the second side electrode 130*b*. When the switch 185 is in a first position, labelled as "a" in FIG. 3, the side electrodes 130*a*, 130*b* are not in communication with the chamber 100. Thus, when the switch 185 is in position "a", the side electrodes 130*a*, 130*b* are electrically floating. When the switch 185 is in the second position, labelled as "b" in FIG. 3, the side electrodes 130*a*, 130*b* are in electrical communication with the chamber 100 such that the side electrodes 130*a*, 130*b* are grounded.

Thus, in certain, embodiments, the controller 180 is in communication with the select signal of the switch 185. The controller 180 may receive an input from a user or operator that indicates which feed gas is being introduced into the chamber 100. Based on the desired feed gas, the controller 180 may provide an output to the select signal of the switch 185 so as to open or close the switch 185. As stated above, in certain embodiments, the side electrodes 130*a*, 130*b* are preferably grounded, such as in the case of arsenic-based feed gasses, such as arsine. In other embodiments, it may be desirable to allow the side electrodes 130*a*, 130*b* to float, such as in the case of boron-based feed gasses, such as boron trifluoride. Thus, the controller provides an output such that the switch 185 is in the second position (i.e. the switch is closed) when a first species, such as arsine, is selected by the user. The controller provides an output such that the switch 185 is in the first position (i.e. the switch is open) when a second species, such as boron trifluoride, is selected by the user.

Figure 4:
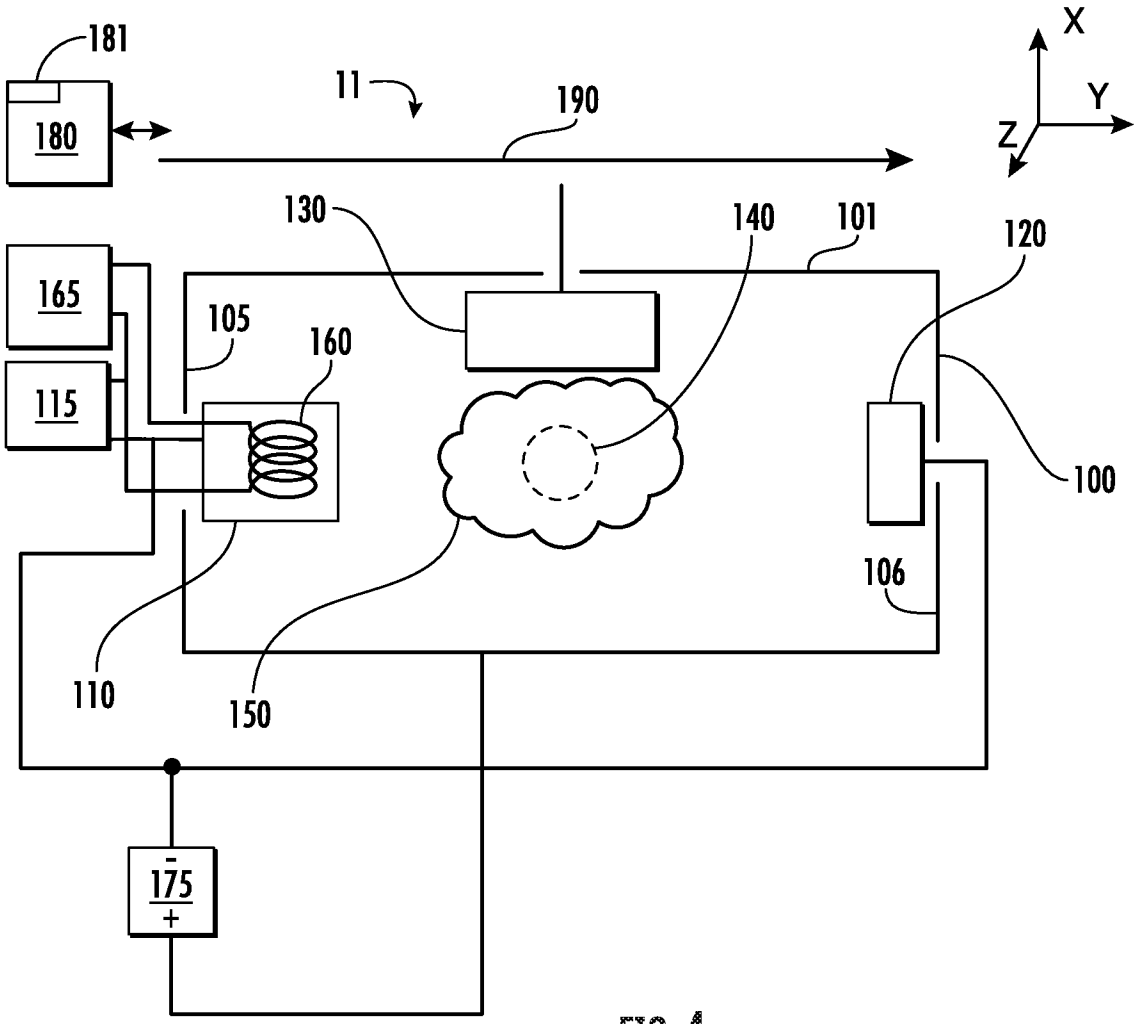
FIG. 4 is an ion source in accordance with a third embodiment.
Figure 5:
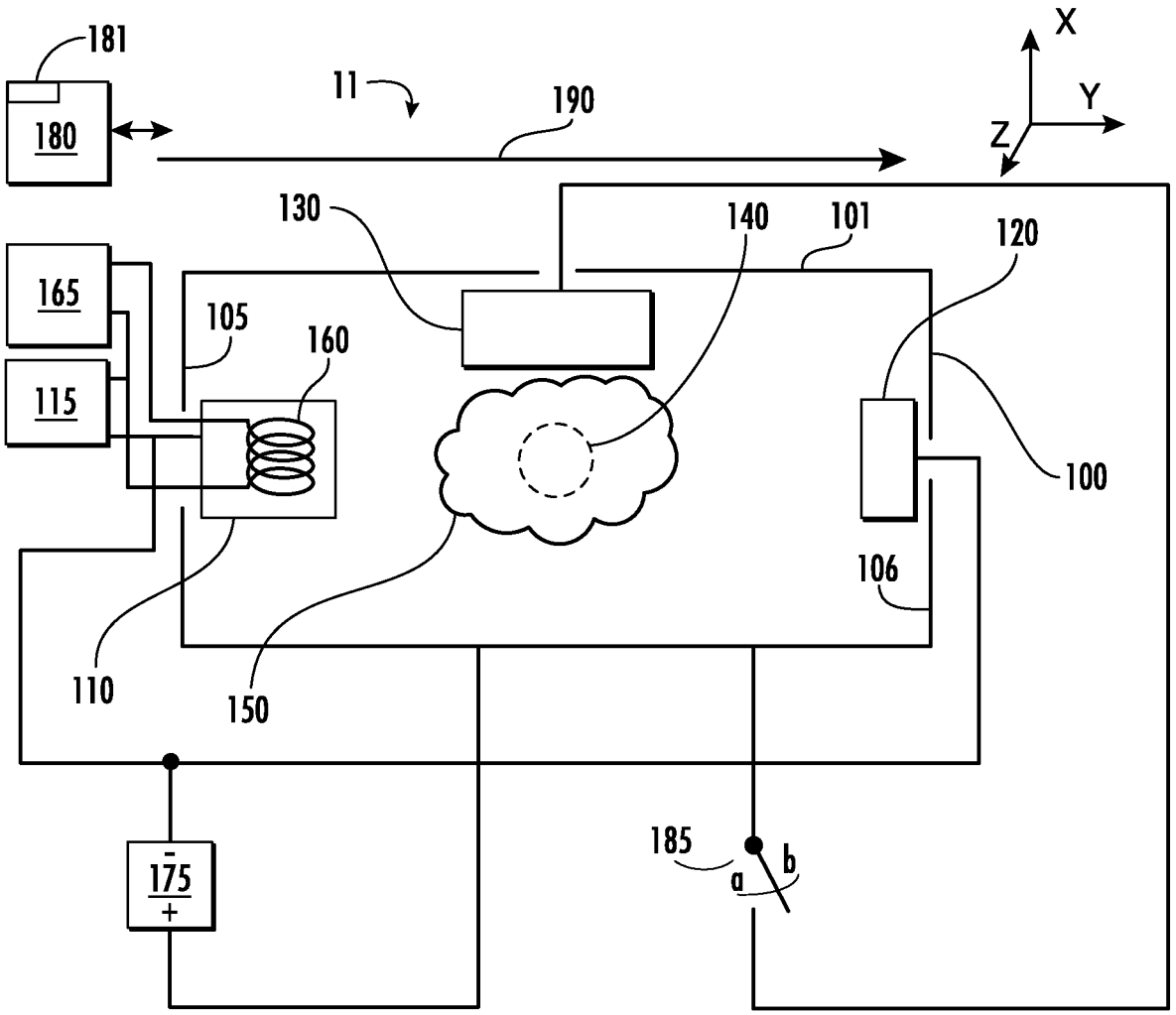
FIG. 5 is an ion source in accordance with a fourth embodiment.

While the above disclosure describes an IHC ion source having two side electrodes, 130*a*, 130*b*, the disclosure is not limited to this embodiment. For example, FIG. 4 shows another IHC ion source 11 which has only one side electrode 130. The side electrode 130 is electrically floating. All other aspect of this IHC ion source 11 are the same as was described above with respect to FIG. 1. FIG. 5 shows an IHC ion source 11 of FIG. 4 which includes a switch 185. In all other respects, this IHC ion source 11 is the same as the ion source 10 shown in FIG. 3.

Furthermore, while the above disclosure is described with respect to an IHC ion source, the disclosure is not limited to this embodiment. For example, the ion source may be a Bernas ion source. A Bernas ions source is similar to an IHC ion source, but lacks a cathode. In other words, thermionic electrons are emitted directly from the filament into the chamber and these electrons are used to energize the plasma. Alternatively, the configuration circuit may be used with a Calutron ion source, which is similar to a Bernas ion source, but lacks a repeller. Similarly, the present disclosure is also applicable to a Freeman ion source, where the filament extends from one end of the ion source to the opposite end.

The embodiments described above in the present application may have many advantages. By electrically connecting the side electrodes to a negative power supply, the voltage that is supplied to the side electrodes may be easily manipulated and optimized, based on the feed gas. In one test, the side electrodes of the ion source were grounded to the chamber walls and boron trifluoride was introduced into the chamber. The feed gas was introduced at 4.75 sccm, with an additional 0.80 sccm of a diluent gas (hydrogen). The output current was set to 40 mA. It was found that the 14.8 mA of the total beam current was singly charged boron ions (i.e. $B^+$), as measured using Faraday cups. This implies a boron fractionalization of about 37%. The side electrodes were electrically floated and the test was repeated with all other parameters left unchanged. In this second test, it was found that 17.9 mA of the total beam current was singly charged boron ions. This implies a boron fractionalization of 44.8%. Thus, an increase in boron fractionalization of about 21% was achieved by electrically floating the side electrodes. In contrast, it was found that, when arsine was used as the feed gas, arsenic fractionalization was actually reduced when the side electrodes were allows to electrically float. Thus, the production of singly charged arsenic ions may be optimized by electrically connecting the side electrodes to the chamber 100. The use of a switch in communication with the side electrodes and the chamber allows these changes to be easily implemented.

Further, increased fractionalization implies more dopant beam current. Currently, the fabrication of improved power device, such as those used in electric cars, uses more beam current at medium energies such as 250 keV in order to perform high dose implants, where the dose may be 5E15/$cm^2$ or greater.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An ion source, comprising:

a chamber, comprising at least one electrically conductive wall, wherein the chamber comprises two ends and side walls connecting the two ends;

a cathode disposed on one end of the chamber;

a first side electrode disposed on one side wall; and an arc power supply to bias the cathode at a negative voltage relative to the electrically conductive wall;

wherein the first side electrode is electrically floating.

2. The ion source of claim 1, further comprising a second side electrode disposed on a second side wall, wherein the second side electrode is electrically floating.

3. The ion source of claim 1, further comprising a repeller disposed on an opposite end of the chamber.

4. An ion source, comprising:

a chamber, comprising at least one electrically conductive wall;

a cathode disposed on one end of the chamber;

a first side electrode disposed on one side wall; and a switch having two terminals, wherein a first terminal is in communication with the electrically conductive wall and a second terminal is in communication with the first side electrode, wherein when the switch is in a first position, the first side electrode is electrically floating and when the switch is in the second position, the first side electrode is in communication with the electrically conductive wall.

5. The ion source of claim 4, wherein the switch comprises a select signal to select between the first position where the switch is open and the second position where the switch is closed.

6. The ion source of claim 5, further comprising a controller in communication with the select signal.

7. The ion source of claim 6, wherein the controller selects between the first position and the second position, based on a feed gas that is used.

8. The ion source of claim 7, wherein the controller sets the switch to the second position if an arsenic-based feed gas is used.

9. The ion source of claim 7, wherein the controller sets the switch to the first position if a boron-based feed gas is used.

10. The ion source of claim 4, wherein the switch comprises a relay.

11. The ion source of claim 4, wherein the switch comprises a single pole, single throw switch.

12. The ion source of claim 4, further comprising a second side electrode disposed on a second side wall, wherein the second side electrode is in communication with the first side electrode and the second terminal.

13. The ion source of claim 4, further comprising an arc power supply to bias the cathode at a negative voltage relative to the electrically conductive wall.

14. The ion source of claim 4, further comprising a repeller disposed on an opposite end of the chamber.

15. An ion source comprising:

a chamber, comprising at least one electrically conductive wall;

a filament disposed on one end of the chamber;

a first side electrode disposed on one side wall;

a switch having two terminals, wherein a first terminal is in communication with the electrically conductive wall and a second terminal is in communication with the first side electrode, such that the switch has a first position wherein the first side electrode is electrically floating and a second position wherein the first side electrode is in communication with the electrically conductive wall; and a controller, in communication with the switch, wherein the controller receives an input and selects the first position or the second position, based on the input.

16. The ion source of claim 15, further comprising a cathode, wherein the filament is disposed behind the cathode.

17. The ion source of claim 16, further comprising an arc power supply to bias the cathode at a negative voltage relative to the electrically conductive wall.

18. The ion source of claim 15, further comprising a second side electrode disposed on a second side wall wherein the second side electrode is in communication with the first side electrode and the second terminal.

19. The ion source of claim 15, further comprising a repeller disposed on an opposite end of the chamber.

* * * * *